United States Patent [19]

Ohba

[11] 4,347,544

[45] Aug. 31, 1982

[54] INJECTOR DRIVE CIRCUIT

[75] Inventor: Masahiro Ohba, Okazaki, Japan

[73] Assignee: Nippondenso Co., Ltd., Kariya, Japan

[21] Appl. No.: 209,119

[22] Filed: Nov. 21, 1980

[30] Foreign Application Priority Data

Nov. 28, 1979 [JP] Japan ..... 54-153983

[51] Int. Cl.[3] ..... H01H 47/32

[52] U.S. Cl. ..... 361/154; 123/490

[58] Field of Search ..... 361/152, 153, 154; 123/490

[56] References Cited

U.S. PATENT DOCUMENTS

| | | | |
|---|---|---|---|
| 4,092,717 | 5/1978 | Di Nunzio | 123/490 X |
| 4,134,367 | 1/1979 | Ferry et al. | 123/490 X |
| 4,173,030 | 10/1979 | Rabe | 361/154 |
| 4,180,026 | 7/1979 | Schulzke et al. | 361/154 |
| 4,225,898 | 9/1980 | Weber et al. | 361/154 |
| 4,234,903 | 11/1980 | Harper | 361/154 |

*Primary Examiner*—Reinhard J. Eisenzopf

*Attorney, Agent, or Firm*—Cushman, Darby & Cushman

[57] ABSTRACT

An injector drive circuit for driving an injector having a valve opened and closed according to a pulse signal with the pulse duration thereof corresponding to the quantity of fuel supplied to the engine. The injector drive circuit comprises a current supply power transistor connected to an injector coil. According to an electric pulse signal from a fuel injection control circuit, a first current control section causes base current to flow into the power transistor for causing a peak current through the injector coil. When a predetermined peak current is detected, the base current supplied by the first current control section is cut off. From this instant till the disappearence of the electric pulse signal, a second current control section, which supplies base current to the power transistor only when the current supplied from the power transistor to the injector coil becomes lower than a working current level, supplies in effect the working current through the power transistor to the injector.

6 Claims, 4 Drawing Figures

INJECTOR DRIVE CIRCUIT

This invention relates to an injector drive circuit for a fuel injection system, which comprises a control circuit for calculating the fuel quantity supplied to the engine as the corresponding duration of an electric pulse signal and an injector valve opened for the duration of the electric pulse signal from the control circuit, and, more particularly, to an injector drive circuit which can make the optimum control of the current supplied to the injector.

A prior-art example of the drive circuit of this kind is disclosed in Japanese Patent Laid-open Publication No. 125932/1977 which corresponds to U.S. Pat. No. 4,180,026. FIG. 1 is a schematic showing of the disclosed drive circuit, and FIG. 2 is a waveform chart illustrating the operation of the circuit. When a control circuit ECU, which calculates the quantity of fuel supplied to the engine as the corresponding injection period, supplies a pulse signal $\tau$ as shown in (a) in FIG. 2, the output of a comparator 1 is inverted to a low level as shown in (b) in FIG. 2. This signal is converted by a voltage converter 2 into a high level, thus triggering a transistor $Tr_1$. As a result, current is caused to flow through an injector 130, and the emitter voltage on the transistor $Tr_1$ is caused to gradually increase as shown in (e) in FIG. 2 as this current produces the voltage drop across a resistor $R_1$ connected between the emitter and earth. As soon as this voltage exceeds a first reference voltage $V_1$ of a comparator 3, the output thereof is inverted to a high level as shown in (c) in FIG. 2. This high level signal is coupled to the voltage converter 2 for cutting off the transistor $Tr_1$. With the cutting-off of the transistor $Tr_1$ in this way, the current in the injector 130 vanishes. (This means that the current is not caused to flow beyond a peak current corresponding to the first reference voltage $V_1$.) As a result, the emitter voltage on the transistor $Tr_1$ is reduced to a low level, so that the output of the comparator 3 is again inverted to a low level as shown in (c) in FIG. 2. At this time, however, the signal $\tau$ from the ECU is still at the high level, so that the output of the comparator 1 is still at the low level. Thus, as soon as the output of the comparator 3 is inverted to the low level, current is caused to flow again through the injector. In the meantime, at the time of the inversion of the output of the comparator 3 to the high level caused when the first reference voltage $V_1$ of the comparator 3 is exceeded by the emitter voltage of the transistor $Tr_1$, the output of a bistable multivibrator 4 is inverted to a low level as shown in (d) in FIG. 2, and with this low level signal the reference voltage of the comparator 3 is changed from the aforementioned first reference voltage $V_1$ to a second reference voltage $V_2$ lower than the first. For this reason, as soon as the emitter voltage of the transistor $Tr_1$, being increased again as shown in (e) in FIG. 2 with the current caused again through the injector 130, exceeds this time the second reference voltage $V_2$ of the comparator 3, the output thereof is inverted to the high level as shown in (c) in FIG. 2, thus cutting off the transistor $Tr_1$. As a result, the emitter voltage on the transistor $Tr_1$ is reduced to the low level, so that the output of the comparator 3 is inverted to the low level again. In this way, the current through the injector 130 can be held at a value corresponding to the second comparison voltage $V_2$. This current value is low in comparison with the peak current and is substantially constant. When the signal $\tau$ supplied to the comparator 3 is inverted from the high level to a low level, the transistor $Tr_1$ is cut off, causing the inversion of the output of the bistable multivibrator 4 to a high level to be ready for the repetition of the operation with the subsequent inversion of the signal $\tau$ from the low level to the high level. A delay circuit 5 is provided to provide a slight delay time from the instant of the inversion of the output of the bistable multivibrator 4 to the low level so as to delay the timing of the triggering of a transistor $Tr_2$ for the purpose of advancing the timing of the instant of opening of the injector valve by making use of the back electromotive force produced when the current in the injector 130 is cut off upon reaching of the peak current. A flyback control section 6 is provided for absorbing back electromotive forces produced with the on-off operation of the transistor $Tr_1$ within the working range of the injector current after the inversion of the output of the bi-stable multivibrator 4 into the low level and also after the inversion of the output of the delay circuit 5 to the low level.

The above prior-art injector drive circuit, however, has the following drawback.

(1) It has a complicated circuit construction.

(2) The peak current and working current (i.e., the first and second reference voltages $V_1$ and $V_2$ of the comparator 3) cannot be adjusted independently, and also the adjustment requires a considerable time.

The present invention is intended in the light of the above, and it has for its object to provide an injector drive circuit for driving an injector having a valve opened and closed according to a pulse signal with the pulse duration thereof corresponding to the quantity of fuel supplied to the engine, which injector drive circuit comprises a power transistor with the collector-emitter path thereof connected in series with an injector coil for supplying current to the injector coil for the pulse duration of the pulse signal, a first comparator circuit section for determining whether a peak current of a predetermined value has been caused to flow through the injector coil after the appearance of the pulse signal or not, a second comparator circuit section for determining whether a working current of a preset value has been caused to flow through the injector coil after the peak current has been caused through the injector coil or not, a first current control section for supplying current to the base of the power transistor for a period until the first comparator circuit section detects the peak current through the injector coil during the presence of the pulse signal, and a second current control section for supplying current to the base of the power transistor only when the second comparator circuit section determines that no working current is flowing through the injector coil after the detection of the peak current through the injector coil by the first comparator circuit section during the presence of the pulse signal, and with which it is possible to adjust the peak current and working current independently and simply and also obtain digital and simple processing of signal by merely controlling the switching of the first and second current control sections by the first comparator control section, thus permitting the simplification of the circuit construction.

With the injector drive circuit according to the invention for driving an injector having a valve opened and closed according to a pulse signal with the pulse duration thereof corresponding to the quantity of fuel supplied to the engine, which comprises a power transistor with the collector-emitter path thereof connected in series with an injector coil for supplying current to the injector coil for the pulse duration of the pulse signal, a first comparator circuit section for determining whether a peak current of a predetermined value has been caused to flow through the injector coil after the appearance of the pulse signal or not, a second comparator circuit section for determining whether a working current of a preset value has been caused to flow through the injector coil after the peak current has been caused through the injector coil or not, a first current control section for supplying current to the base of the power transistor for a period until the first comparator circuit section detects the peak current through the injector coil during the presence of the pulse signal, and a second current control section for supplying current to the base of the power transistor only when the second comparator circuit section determines that no working current is flowing through the injector coil after the detection of the peak current through the injector coil by the first comparator circuit section during the presence of the pulse signal, the value of the peak current for opening the injector valve and also the value of the working current for maintaining the open state of the injector valve can each be adjusted independently without affecting the other at all, and thus it is possible to reduce the time required for the adjustment.

Also, since this circuit has a construction in which the switching of the first and second current control sections is controlled on the basis of the result of the determination made by the first comparator circuit section as to whether the peak current has been reached or not, it is possible to obtain digital, i.e., logic, processing and thus permit simplification of the circuit construction.

Figure 1:
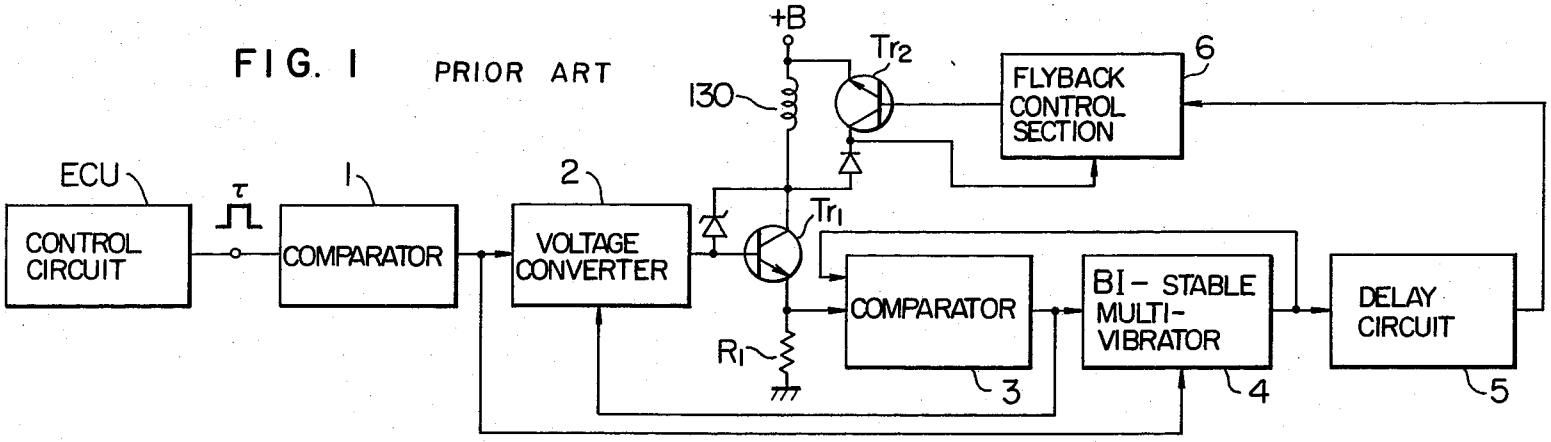
FIG. 1 PRIOR ART
FIG. 1 is a block diagram showing a prior-art injector drive circuit.
Figure 2:
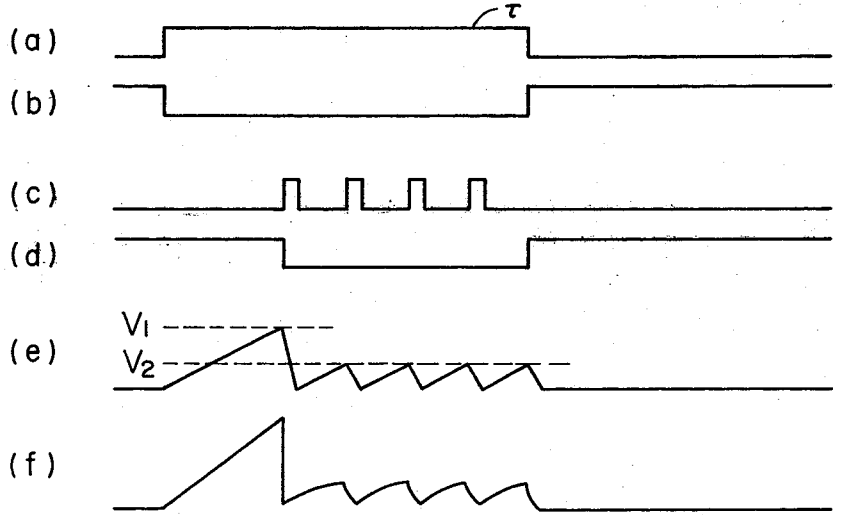
FIG. 2 PRIOR ART
FIG. 2 is a waveform chart showing outputs of various parts of the circuit of FIG. 1.
Figure 3:
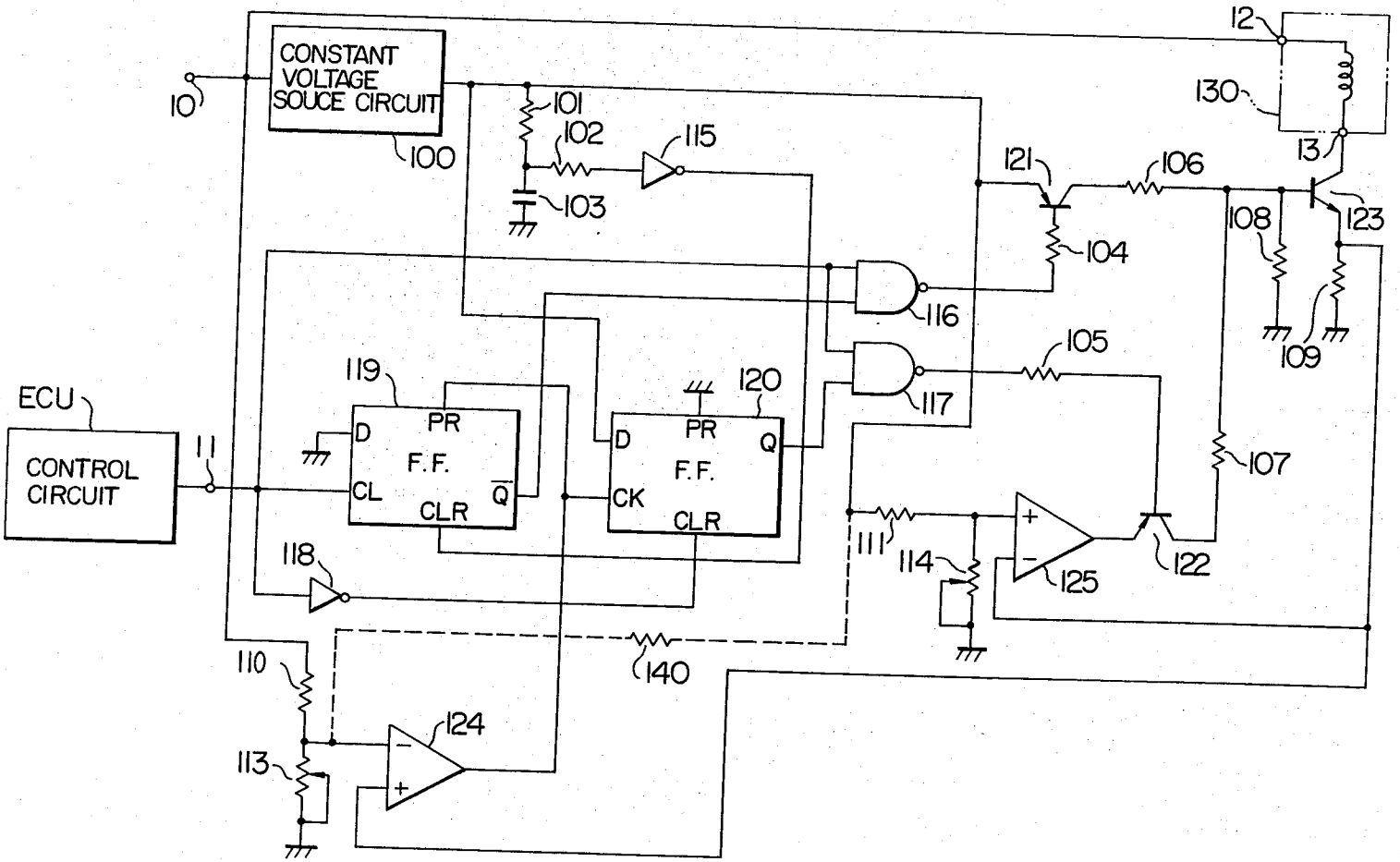
FIG. 3 is a schematic representation of an embodiment of the invention.

Now, an embodiment of the invention shown in FIG. 3 will be described. In FIG. 3, designated at 10 is a power supply terminal, and at 11 a terminal, to which a control signal from a control circuit ECU, i.e., an injection pulse signal, is coupled. Terminals 12 and 13 are connected to the opposite ends of a coil of an injector 130. Designated at 100 is a constant voltage source circuit, and in this embodiment its output voltage is set to 5 V. Designated at 101 and 102 are fixed resistors with respective resistances of 100 KΩ and 10 kΩ. Designated at 103 is a capacitor of 0.1 μF, at 105 a fixed resistor of 20 kΩ, at 106 and 107 fixed resistors of 180 kΩ, at 108, 109, 110, 111 fixed resistors respectively of 4.7 kΩ, 0.2 kΩ, 10 kΩ, 20 kΩ, at 113 a variable resistor of 2 kΩ, and at 114 a variable resistor of 5 kΩ. Designated at 115 and 118 are inverters, at 116 and 117 NAND gates, and at 119 and 120 D-type flip-flops, which are "TC4013" by Toshiba. Designated at 121 and 122 are respective first and second PNP transistors, which are "2SA970" by Toshiba. Designated at 123 is a power transistor, which is "2SD412" by NEC (Nippon Electric Company), and at 124 and 125 are respective first and second comparators, which are "μPC379" by NEC.

Figure 4:
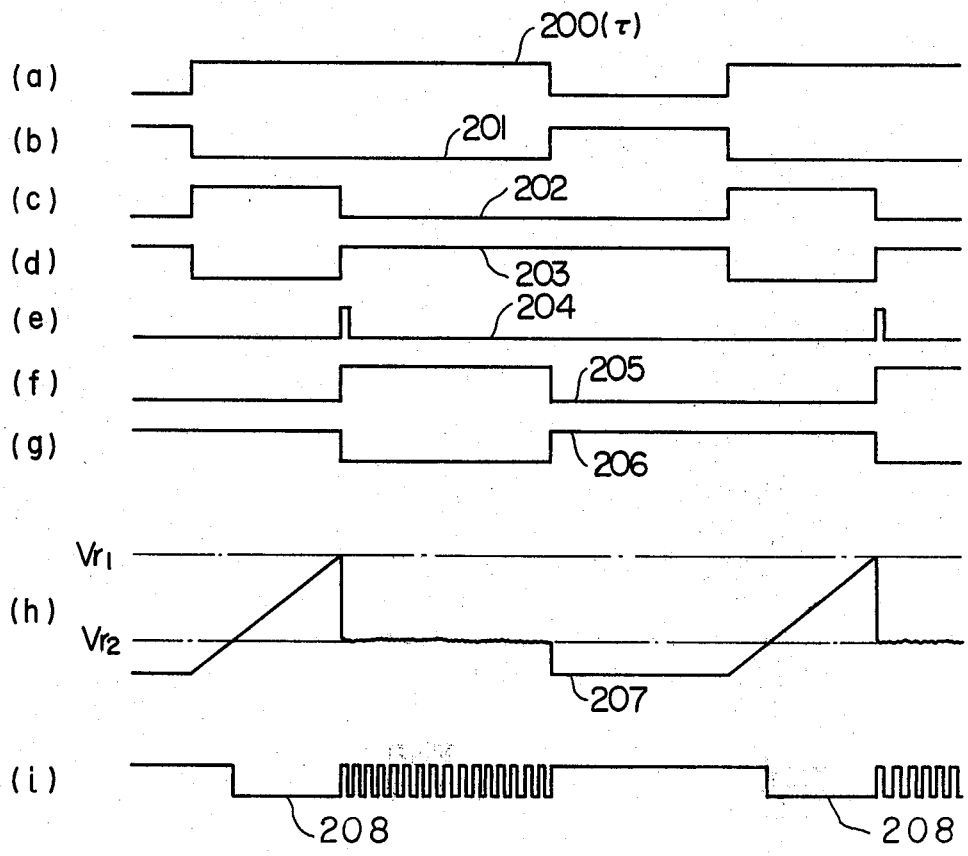
FIG. 4 is a waveform chart showing outputs of various parts of the circuit of FIG. 3.

The operation of the above circuit construction will now be described. When a supply voltage of about 12 V is supplied to the terminal 10 with the closure or throw in of a power supply switch at such time as when starting the engine, in a reset signal generating section constituted by the resistors 101 and 102, capacitor 103 and inverter 115 the output of the inverter 115 is inverted to a high level since the capacitor 103 has not been charged before the closure of the power supply switch. As a result, the capacitor 103, which constitutes a time constant circuit together with the resistor 101, is charged. Thus, the input to the inverter 115 is inverted to a high level to invert the output thereof to a low level. With this low level signal, which is coupled to the clear terminal of the D-type flip-flop 119 (which is "TC4013" by Toshiba, for instance), the Q output thereof becomes to be a high level. In this state, when the signal from the terminal 11 is inverted from a low level to a high level as shown in (a) in FIG. 4, i.e., when the injection pulse signal $\tau$ is supplied, the signal coupled to the clear terminal of the D-type flip-flop 120 is inverted to a low level, thus releasing this flip-flop from the reset state, while at the same time the output of the NAND gate 116 is inverted to a low level as shown in (d) in FIG. 4. With the inversion of this signal, which is coupled through the resistor 104 to the base of the first PNP transistor 121, base current is caused to flow into the first PNP transistor 121 to trigger the transistor 121, thus causing base current into the NPN power transistor 123 to trigger the power transistor 123 so as to cause current to flow through the coil of the injector 130. The waveform of this injector coil current is as shown at 207 in (h) in FIG. 4. The slope of this current waveform is expressed as $$I(t)=(E/R)(1-e^{-Rt/L})$$

where L is the inductance of the coil of the injector 130, R is the resistance of the series resistor, E is the voltage applied across the injector coil, and t is time. With the lapse of time, the current is increased to increase the voltage drop across the resistor 109. This voltage is coupled through the juncture between the resistor 109 and power transistor 123 to the plus side input terminal of the first comparator 124 and also to the minus side input terminal of the second comparator 125. In this embodiment, the reference voltage $Vr_2$ of the second comparator 125 is set to about 0.2 V, and the reference voltage $Vr_1$ of the first comparator 124 is set to about 1.0 V. Thus, at an instant when the voltage across the resistor 109 increasing with time exceeds 0.2 V, the output of the second comparator 125 is inverted to a low level as shown at 208 in (i) in FIG. 4. Then, at a subsequent instant when the voltage across the resistor 109 exceeds 1.0 V, the output of the first comparator 124 is inverted from a low level to a high level as shown in (e) in FIG. 4, thus causing the inversion of the output from the low level to a high level. Since the output of the first comparator 124 is coupled to the preset terminal of the D-type flip-flop 119, at this time the Q output of the D-type flip-flop 119 is inverted to a low level as shown at 202 in (c) in FIG. 4 to cause the inversion of the output of the NAND gate 116 to a high level as shown at 203 in (d) in FIG. 4, thus cutting off the first PNP transistor 121 to cut off the base current and hence the collector current of the power transistor 123 so as to cut off the current through the coil of the injector 130. In other words, when the current through the injector coil reaches the peak current corresponding to the reference voltage $Vr_1$ of the first comparator 124, it is cut off. Meanwhile, since the output of the first comparator 124 is coupled to the CK terminal of the D-type flip-flop 120, at the instant of the inversion of the output of the first comparator 124 from the low level to the high level the Q output of the flip-flop 120 is inverted to a high level as shown at 205 in (f) in FIG. 4 to cause the inversion of the output of the NAND gate 117 to a low level as shown at 206 in (g) in FIG. 4, thus causing base current into the second PNP transistor 122, i.e., rendering the transistor 122 to be capable of being triggered. However, since the output of the second comparator 125 has been at the low level, the second PNP transistor 122 remains "off". Thus, at the instant when the base current to the power transistor 123 is cut off, current is supplied neither from the second transistor 122 nor from the resistor 107, so that the power transistor 123 is held "off". Thus, the current in the coil of the injector 130 is cut off, so that the voltage across 109 is quickly reduced toward the low level. When this voltage becomes lower than 0.2 V, the output of the second comparator 125 is inverted to a high level, thus causing current to flow through the second PNP transistor 122 and resistor 107 to the base of the power transistor 123 for causing current again through the coil injector. In other words, when the voltage across the resistor 109 becomes lower than the reference voltage $Vr_2$ of the second comparator 125, current is caused again through the injector coil. Thus, the voltage across the resistor 109 is caused to rise again, and when it exceeds 0.2 V the output of the second comparator 125 is inverted toward the low level to cut off the base current and hence the collector current of the power transistor 123, thus causing the voltage across the resistor 109 to be reduced again toward the low level. When the voltage across the resistor 109 subsequently becomes lower than 0.2 V again, the output of the second comparator 125 is inverted again as mentioned earlier. This operation of the second comparator 125 is repeated so long as the signal supplied to the terminal 11 is at the high level (i.e., during the period in which the injection pulse $\tau$ is outputted) as shown in (i) in FIG. 4.

When the pulse signal $\tau$ at the terminal 11 is inverted from the high level to the low level, the output of the NAND gate 117 is inverted to a high level to cut off the second PNP transistor 122. Thus, the above switching operation is stopped, so that the current through the coil of the injector 130 is completely cut off. Since the signal from the terminal 11 is coupled through the inverter 118 to the clear terminal of the D-type flip-flop 120, with the inversion of the signal from the terminal 11 to the low level the output of the inverter 118 is inverted to a high level as shown in (b) in FIG. 4 to reset the D-type flip-flop 120, and the Q output thereof becomes to a low level.

In this way, at the subsequent instant when the pulse signal $\tau$ from the terminal 11 is inverted again from the high level to the low level the output of the NAND gate 116 alone is inverted to the low level, so that the first PNP transistor 121 is triggered to repeat the above operation.

While in the above embodiment the reference voltage $Vr_1$ of the first comparator 124 is provided through the division of the supply voltage between the resistors 113 and 114, so that it is greatly affected by the changes of the supply voltage. This effect of the changes of the supply voltage may be reduced by adding a constant voltage coupled from the constant voltage source circuit 100 through a resistor 140 as shown by dashed line in FIG. 3.

Further, while the above embodiment has concerned with a single injector 130, it is possible to obtain the same effects where a plurality of injectors are connected.

I claim:

1. An injector drive circuit for driving an injector having a valve opened and closed according to a pulse signal with the pulse duration thereof corresponding to the quantity of fuel supplied to the engine, comprising a power transistor with the collector-emitter path thereof connected in series with an injector coil for supplying current to said injector coil for the pulse duration of said pulse signal, a first comparator circuit section for determining whether a peak current of a predetermined value has been caused to flow through said injector coil after the appearance of said pulse signal or not, a second comparator circuit section for determining whether a working current of a preset value has been caused to flow through said injector coil after the peak current has been caused through said injector coil or not, a first current control section for supplying current to the base of said power transistor for a period until said first comparator circuit section detects said peak current through said injector coil during the presence of said pulse signal, and a second current control section for supplying current to the base of said power transistor only when said second comparator circuit section determines that no working current is flowing through said injector coil after the detection of said peak current through said injector coil by said first comparator circuit section during the presence of said pulse signal.

2. An injector drive circuit as claimed in claim 1, wherein said circuit further includes a resistor for detecting current, said resistor being connected to an emitter of said power transistor, said first comparator circuit section includes a first comparator and first means for supplying a reference voltage to said first comparator, said first means including a variable resistor, and said second comparator circuit section includes a second comparator and second means for supplying a reference voltage to said second comparator, said second means including a variable resistor.

3. An injector drive circuit as claimed in claim 1 or 2, wherein said circuit includes a circuit means for actuating said first current control section in response to the rise of said pulse signal and for stopping the actuation of said second current control section to stop supply of current to said power transistor, said circuit means including two flip-flops which receive said pulse signal and two gate means.

4. An injection drive circuit as claimed in claim 3, wherein said circuit includes a reset signal generating circuit for initializing one of said flip-flops, said reset signal generating means operating at the time of switch on of power.

5. An injection drive circuit as claimed in claim 3, wherein said first current control section includes a first transistor, said second current control section includes a second transistor, base current of said first transistor is controlled by one of said gate means, base current of said second transistor is controlled by another of said gate means, and an emitter of said second transistor is connected to an output terminal of said second comparator.

6. An injection drive circuit as claimed in claim 2, wherein the reference voltage to said first comparator is about 0.2 V and the reference voltage to said second comparator is about 1 V.

* * * * *